US008459197B2

(12) United States Patent
Jordan

(10) Patent No.: US 8,459,197 B2
(45) Date of Patent: Jun. 11, 2013

(54) APPARATUS TO TRACK MOVEMENT OF A SKIER

(75) Inventor: Jeff Jordan, Baton Rouge, LA (US)

(73) Assignee: Southern Audio Services, Inc., Baton Rouge, LA (US)

( * ) Notice: Subject to any disclaimer, the term of this patent is extended or adjusted under 35 U.S.C. 154(b) by 158 days.

(21) Appl. No.: 12/971,027

(22) Filed: Dec. 17, 2010

(65) Prior Publication Data

US 2012/0152162 A1 Jun. 21, 2012

(51) Int. Cl.
*B63B 21/56* (2006.01)

(52) U.S. Cl.
USPC ..... 114/253; 114/343; 114/364

(58) Field of Classification Search
USPC ..... 114/253, 364, 343
See application file for complete search history.

(56) References Cited

U.S. PATENT DOCUMENTS

| | | | | | |
|---|---|---|---|---|---|
| 2,907,295 | A * | 10/1959 | Delaney | ..... | 114/253 |
| 4,624,141 | A * | 11/1986 | Soleau | ..... | 73/865.8 |
| 5,018,474 | A * | 5/1991 | Jellen | ..... | 114/253 |
| 5,694,337 | A * | 12/1997 | Macken | ..... | 441/68 |
| 6,539,886 | B2 * | 4/2003 | Henry et al. | ..... | 114/253 |

* cited by examiner

*Primary Examiner* — Lars A Olson
(74) *Attorney, Agent, or Firm* — Roy Kiesel Ford Doody & Thurmon, APLC

(57) ABSTRACT

Apparatus mountable to a boat tower or pylon used to tow a skier, water boarder, tuber or rafter including an elongated arm pivotally mounted to the boat tower or pylon, a tow rope post fixed to the arm and including a tether guide ring through which a tow rope may be threaded and a mounting member to which one end of the tow rope may be secured. The apparatus will also include a sensor that detects the change in position of the tow rope post from a predetermined fixed position caused by the lateral movement of the person being towed. The elongated arm may have speaker and/or light mounts to fix speakers and/or lights to the elongated arm in a position to track the movements of the towed person and may further include a securing means to fix the elongated arm in a given position.

9 Claims, 4 Drawing Sheets

APPARATUS TO TRACK MOVEMENT OF A SKIER

BACKGROUND OF THE INVENTION

1. Field of the Invention

This invention relates in general to an accessory that can be mounted on a boat tower or tow pylon, and more particularly to an accessory mountable on a boat tower to track the position of a person being towed by the boat.

2. Prior Art

To enhance the experience of a water skier, water boarder, or water rafter being towed behind a boat it is common to attach the tether to a tower that has been constructed to extend above the boat. Typically, these towers extend 3 to 10 feet about the boat bow and have the tether attached to a post or fixed ring positioned at or near the top of the tower. Examples of such towers are illustrated in U.S. Pat. Nos. 5,788,133, 6,575,112, 6,997,131, and 7,299,761, as well as in U.S. Published Patent Application Nos. 2008/0289561, 2004/0159278 and 2002/0046690.

It is also well known that one can affix lights, audio speakers and other accessories to the boat towers to help guide the boat at dusk or night, as well as to enhance the boating experience when not towing persons. An example of such use is illustrated in U.S. Pat. Nos. 7,017,509 and 7,007,904, as well as in U.S. Published Patent Application Nos. 2008/0049958, 2007/0062992, and 2006/0037527.

However, there remain several problems that current towing assemblies do not address. One is the ability of the person being towed having a heightened experience by being able to clearly hear music while being towed. Another is the ability of the driver who must face forward to steer the boat to know where the towed person is positioned behind the boat. In competitive or pleasure performances this can result in the boat being steered to sharply veer in the direction of the towed person resulting in slacking of the tether and slowing of the speed of the towed person. When this occurs the towed person may not be able to successfully launch from a ramp or perform other water tricks. Another problem is communication between the boat driver and the towed person. Still another problem is coordinating the timing between the boat driver and towed person when steering or accelerating the boat. Yet another problem is highlighting the towed person at dusk or at night. Still further, problems occur when the tow boat is used as the lighting and sound center when the boat is docked.

OBJECTS AND SUMMARY OF THE INVENTION

Therefore, one object of this invention is to provide an assembly attachable to a boat tower or towing pylon that can track the lateral movements of the towed person and direct speakers to track the lateral movements to provide the towed person to hear a clear and sharp sound being emitted from the speakers.

Another object of the invention is to provide an assembly attachable to a boat tower or towing pylon that can track the lateral movements of the towed person and electronically relay to a monitor the position of the towed person.

Still another object of this invention is to provide an assembly attachable to a boat tower or towing pylon and provided with lights that can be directed toward the towed person position.

Yet another object of this invention is to provide an assembly that can provide one or more of the above objects of this invention and when the boat is docked permit the speakers and lights to be independently or dependently directed toward a desired position.

Other objects and advantages of this invention shall become apparent from the ensuing descriptions of the invention.

Accordingly, this invention in one embodiment comprises an apparatus mountable to a boat tower or pylon used to tow a skier, water boarder, tuber or rafter including an elongated arm pivotally mounted to the boat tower or tow pylon, a tow tether post fixed to the arm and including a tether guide ring through which a tow tether may be threaded and a mounting member to which one end of the tow tether may be secured.

In a more preferred embodiment the apparatus will also include a sensor that detects the change in position of the tow rope post from a predetermined fixed position that is caused by the lateral movement of the person being towed. In this embodiment the sensor is electronically connected an electronic processor that receives a signal from the sensor representative of the amount of lateral movement of the person. The processor is electronically operatively connected to a motor operatively attached to speakers pivotally mounted on the tower or pylon to direct the speakers toward the towed person. In a preferred embodiment the elongated arm will have speaker and/or light mounts to fix speakers and/or lights to the elongated arm in a position to track the movements of the towed person. In this embodiment it is further preferred that the elongated arm be hollow or provided with grooves for speaker wire to be positioned substantially out of sight and out of the weather. In such an embodiment it is preferred that the post have opening and be fixed to the boat tower to permit the speaker wires to be positioned into the post and be operatively attached to a commutator to prevent the wires from being bent and broken as the post rotates. Corresponding wires would be attached to the commutator and extended through the boat tower or pylon tubular structure to the boat cabin or cockpit where they may be operatively attached to an audio source, such as an audio receiver. It would be further preferred if the audio receiver had multiple channels that permitted operative attachment of a radio transmitter, a CD player or a public address system.

In another embodiment the processor processes the signal and transmits a processed signal, either via wires or wirelessly, to a video screen or visual readout or indicator which displays the change in lateral position of the person.

In another preferred embodiment the elongated arm includes a securing means, such as known set screw, cotter pin or other stop structures, that permits the elongated arm to be fixed in one or more given position.

BRIEF DESCRIPTION OF THE DRAWINGS

The accompanying drawing illustrates a preferred embodiment of this invention. However, it is to be understood that this embodiment is not intended to be exhaustive, nor limiting of the invention.

PREFERRED EMBODIMENTS OF THE INVENTION

Without any intent to limit the scope of this invention, reference is made to the figures in describing the preferred embodiments of the invention. Although the invention is described when used to tow a skier behind a ski boat, the invention can also be used to a person on a water board, a rubber inner tube, a raft, or similar device.

Figure 1:
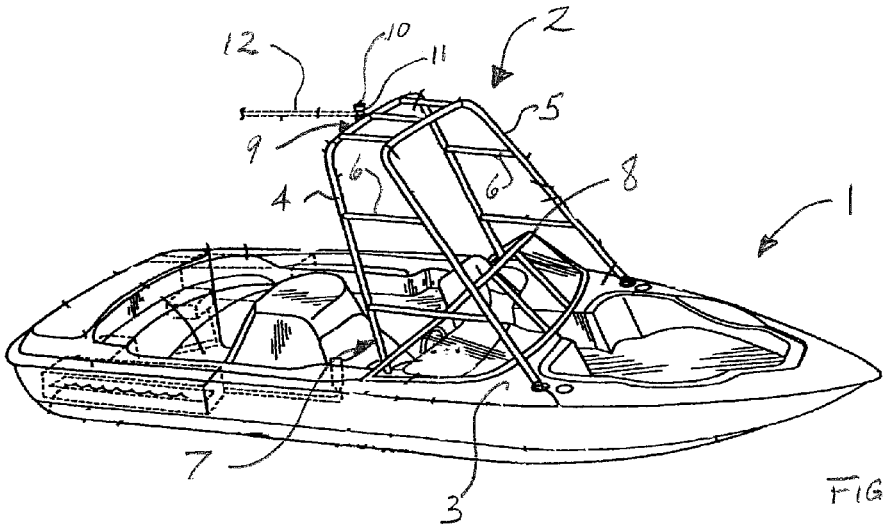
FIG. 1 illustrates one embodiment of a typical ski boat provided with a boat tower to assist in towing a skier.
Figure 1A:
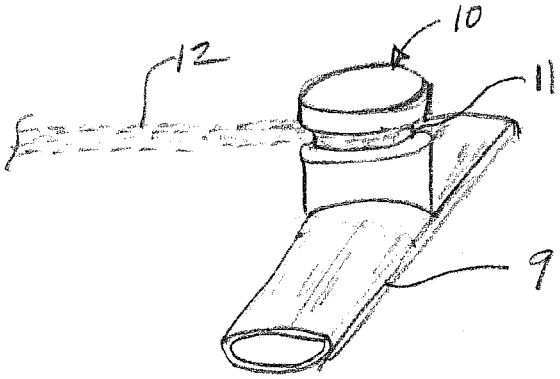
FIG. 1A illustrates a typical tow rope attaching post structure used in FIG. 1.

Referring now to FIG. 1, a typical ski boat 1 is illustrated having tower 2 affixed to boat decking structure 3. Tower 2 is constructed generally of two U-shaped tubular members 4 and 5 and fixed in position relative to one another by horizontal tubular members 6 to form a rigid structure. Typically, tower 2 will be positioned over boat cockpit 7 and extend over each side of front windshield 8 so as to center the weight of tower 2 evenly over the width of boat 1 to allow for better handling of boat 1 when towing a skier (not shown). Referring now to FIGS. 1 and 1A, affixed to top center section 9 of member 4 is cylindrical post 10 having indented section 11 encircling post 10. A tow rope or tether 12 having a looped end is fitted over post 10 and into indented section 11 when boat 1 will be used to tow a skier.

Figure 2:
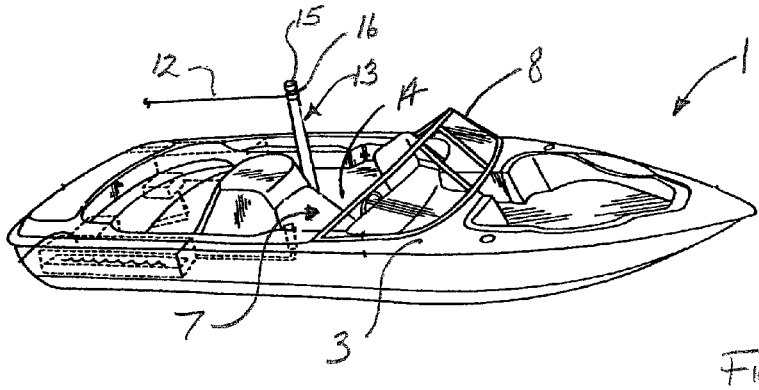
FIG. 2 illustrates an alternate embodiment of a typical ski boat provided with a towing pylon to assist in towing a skier.
Figure 2A:
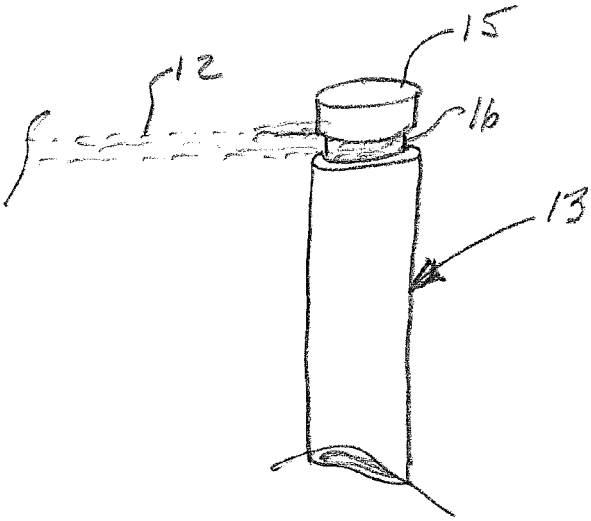
FIG. 2A illustrates a typical tow rope attaching post structure used in FIG. 2.
Figure 3:
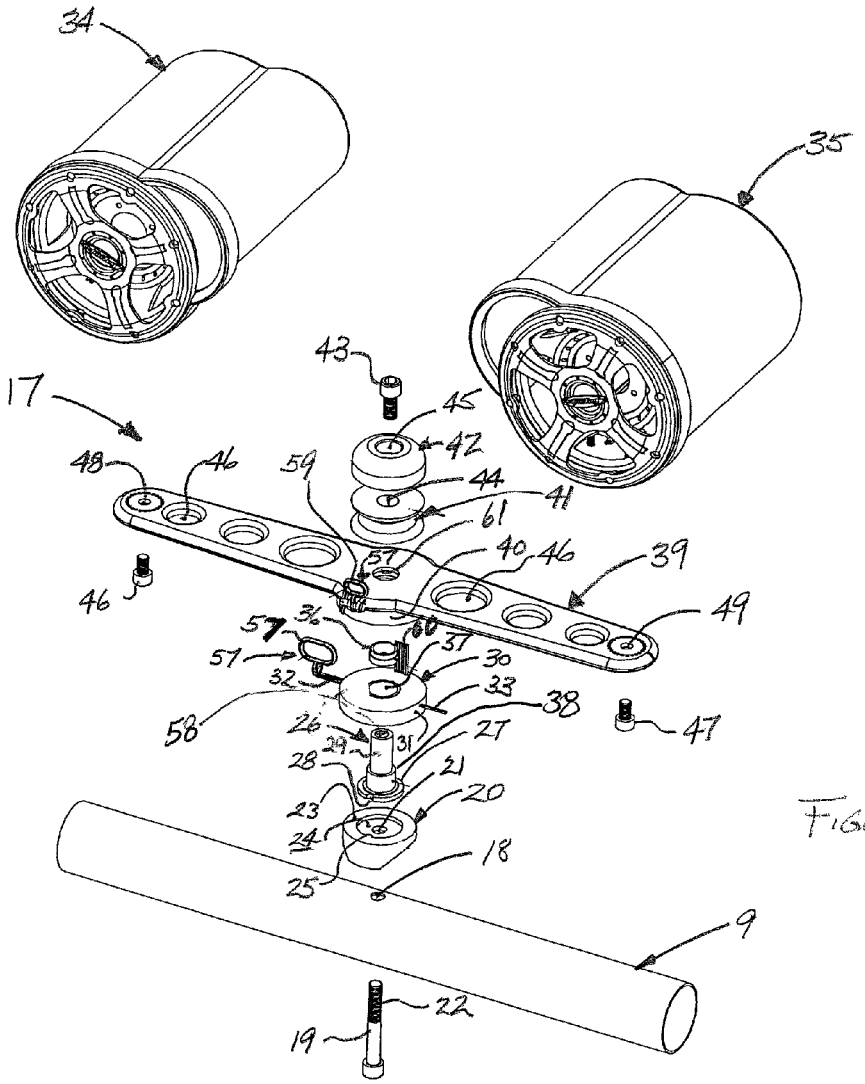
FIG. 3 is an exploded view of a preferred embodiment of the tow rope attachment and accessory rack of this invention.
Figure 5:
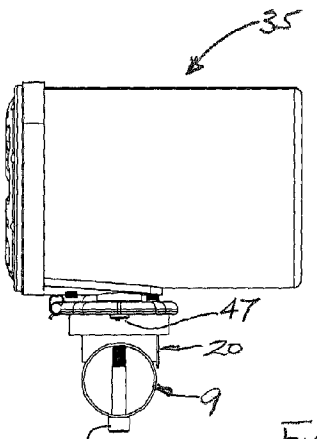
FIG. 5 is a side view of FIG. 3.
Figure 4:
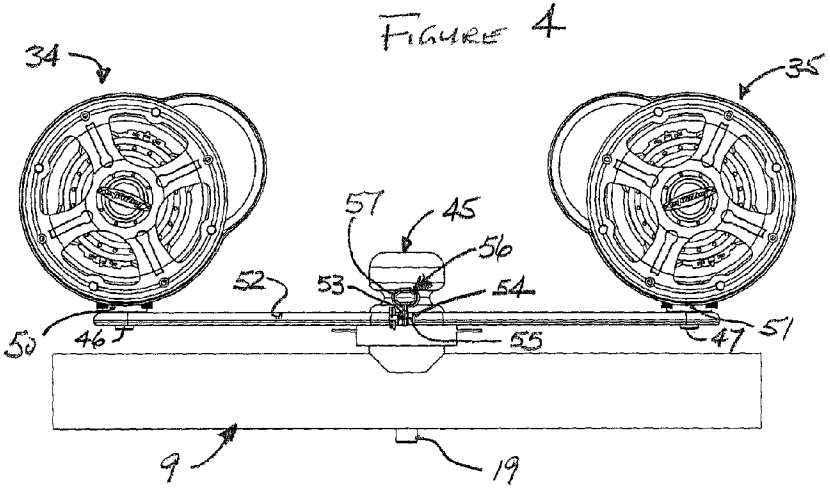
FIG. 4 is a frontal view of the FIG. 3 embodiment of the invention to which speakers have been attached.
Figure 6:
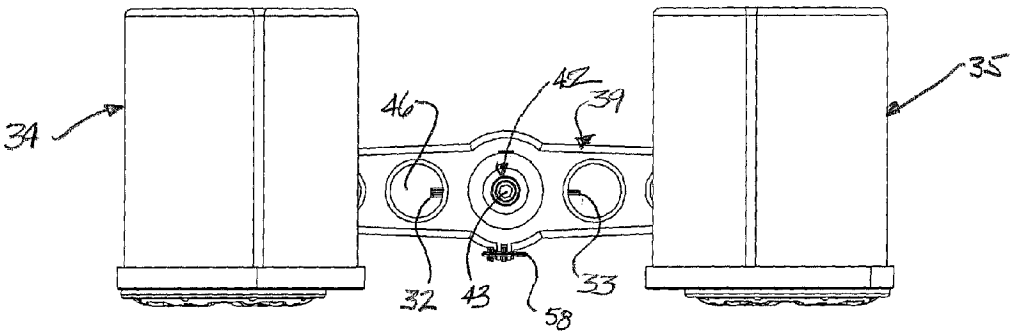
FIG. 6 is a top view of FIG. 3.

FIG. 2 illustrates a similar ski boat 1 which instead of having tower 2 is provided with a pylon 13 fixed to boat floor 14 and extending upward so that its upper end 15 (see FIG. 2A) is positioned sufficiently above the boat floor 14 to permit tow rope or tether 12 to be attached in indented section 16 circling and located at upper end 15 of pylon 13 and extend to the skier (not shown) without touching boat deck 3 when the skier is being towed.

This invention involves an improvement to these conventional tow rope attachment structures. FIG. 3-6 illustrate the ski rope attachment and accessories rack 17 that is attachable to top center section 9 of tower 2. To facilitate the attachment, tower bar section 9 is drilled to provide aligned bolt openings 18 sized to permit bolt 19 to pass through section 9 to attach to tower bar diameter adaptor 20. Adaptor 20 is preferably shaped and sized to sit flush on section 9. In addition adaptor 20 is provided with a opening 21 extending vertically through adaptor 20 and is sized to allow the threaded end 22 of bolt 19 to thread into spindle insert 26 thereby compressibly affixing adaptor 20 to section 9. The upper surface 23 of adaptor 20 is provided with a cavity 24 provided with a key 25 to receive a universal spindle insert 26 having a bottom flange 27 provided with a notch 28 sized to permit key 25 to be positioned in notch 28. Flange 27 is sized to fit within cavity 24 in a manner that prevents flange 27 from rotating. Insert 26 has a hollow threaded spindle 29 extending vertically upward from flange 27. Fitted about spindle 29 is a disc-shaped signal or power commutator 30 to permit a full 360° rotation of arm 39. Extending from its edge surface 31 are electrical input lines 32 and 33 that can be connected to audio speakers 34 and 35, respectively through output line 61. Wear bushing 36 rests on top of the mid-flange 38 of spindle 29. Elongated, hollow arm 39 has lower shroud 40 that fits over commutator 30 and is provided with a cavity to receive bushing 36 about which arm 39 rotates. Arm 39 is also provided with a threaded opening 61 positioned about its vertical center axis through which spindle 29 extends. Tow rope spool 41 and locking cap 42 are then positioned on spindle 29 and held fixed to arm 39 by bolt 43 that extends through aligned openings 44 and 45 of spool 41 and cap 42, respectively, and is screwed into threaded opening 58 of spindle 29. In a preferred embodiment, arm 39 will be provided with a hollow cavity or channel that extends from shroud 40 to each end of arm 39 where speakers 34 and 35 will be attached. This will permit wires attaching the speakers 34 and 35 to an audio receiver or other audio source located in the boat cockpit to be positioned out of sight and better protected from the weather. If desired, arm 39 may have one or more opening 46 formed to reduce the weight of arm 39 to allow it to rotate about bushing 36 more easily. Speakers 34 and 35 can be bolted to arm 39 by bolts 46 and 47, respectively, that pass through arm openings 48 and 49, respectively and into threaded openings in speaker support brackets 50 and 51, respectively. The speakers 34 and 35 may be mounted above or hang below aim 39. Affixed to the center front edge 52 of arm 39 are two spaced apart, parallel shoulder members 53 and 54 having a horizontally positioned axle 55 extending between the two members. Pivotally mounted on axle 55 is rope guide 56. Guide 56 has ring structure 57 through which a tow rope can pass. It is noted guide 56 does not have to be a ring structure, but could be pin or other structure having an opening though which the two rope 12 can pass and be secured. However, these other structures must be designed so that the lateral movement of the tow rope 12 will cause arm 39 to track the tow rope 12 movement.

In operation the end of tow rope 12 is passed through ring 57 and then looped and fixed around rope spool 41. The opposite end of tow rope 12 is provided with at least one handle that is held by the skier when being towed. As a skier moves to the side of ski boat 1 the tow rope 12 contacts one of the ring structure 57 and causes arm 39 to be turned in the direction of the skier. Commutator 30 may be provided with a magnetic or optical encoder (not shown) or other similar device that provides digital or analog pulses that correspond to the angle at which arm 39 has turned. These pulses are reduced to a digital signal by known means and transmitted to a processor, preferably positioned in cockpit 7 or elsewhere protected from the weather, that electronically processes the signal to provide a visual image on a monitor indicating the position of the skier relative to the boat. The monitor is preferably positioned in cockpit 7 where the boat driver can readily see the monitor. In addition to mounting speakers on arm 39, one can mount other accessories such as lights and video cameras. In the event a video camera is mounted on arm 39 the video camera can be operatively connected to the monitor to permit the boat driver or passengers to view the skier performing tricks.

In another preferred embodiment locking means will be affixed to arm 39 that will permit arm 39 to be locked in one of multiple positions. This feature will be beneficial when the ski boat is tied to dock and it is desired to direct the speakers or lights in a fixed direction or when the boat is being operated without a skier other device in tow. In this embodiment the movement of speakers 34 and 35 when the boat is docked or when no skier is being towed can be controlled by separate motors that are operatively attached to the speakers to pan or tilt the speakers in a desired direction.

These and other alternate embodiments of this invention are clear from the foregoing description of one preferred embodiment of the invention. It is the intent of the inventor for his invention as defined by the following claims to cover not only the specific embodiments described but also those other alternate embodiments that are obvious from the described general and preferred embodiments.

What I claim is:

1. An apparatus mountable to a tow boat having a steering cockpit used to tow a person attached to a water device comprising:

a. an elongated arm pivotally mounted to the boat, wherein the elongated arm has mounts to fix accessories to the elongated arm in a position to track the movements of the towed person; and b. a towing tether operatively in contact with the elongated arm to cause the arm to rotate in harmony with the movement of the towing tether caused by a change in direction of the person.

2. The apparatus of claim 1 further comprising a sensor that detects the change in position of the towing tether from a predetermined fixed position that is caused by the lateral movement of the person being towed; the sensor being electronically connected to an electronic processor that receives a signal from the sensor representative of the amount of lateral movement of the person; the processor being electronically connected to a video screen wherein the processor processes the signal and sends a processed signal to the video screen causing the video screen to display an image representative of any change in lateral position of the person.

3. The apparatus of claim 1 wherein the accessories comprise one or more speakers, lights, or combinations thereof.

4. The apparatus of claim 3 wherein the elongated arm has a hollow cavity extending from the mounts to a post to permit electrical wires from the accessories to be positioned substantially out of sight and out of the weather.

5. The apparatus of claim 4 wherein the post has one or more openings or channels positioned to permit the wires to pass through the post and be operatively attached at one end to a commutator to prevent the wires from being bent and broken as the post rotates and wherein corresponding wires would be attached to the commutator and extended through or on boat tower or pylon tubular member to the cockpit where the corresponding wires may be operatively attached to an audio, video or electrical source.

6. The apparatus of claim 5 wherein the audio source would be an audio receiver having multiple channels that permitted operative attachment of multiple audio sources.

7. The apparatus of claim 6 wherein the audio sources comprise a radio transmitter, a CD player, a public address system, or combinations thereof.

8. The apparatus of claim 1 wherein the elongated arm comprises a securing device that permits the elongated arm to be fixed in one or more given position.

9. The apparatus of claim 8 wherein the securing device comprises one or more set screws, cotter pins, spring loaded clevis pins, cam locks or other stop structures.

* * * * *